United States Patent [19]

Brown et al.

[11] 4,325,813

[45] Apr. 20, 1982

[54] PROCESS FOR PRODUCTION OF HIGH OCTANE GASOLINE FROM CATALYTIC CRACKING UNIT

[75] Inventors: Stanley M. Brown, Scotch Plains; William J. Reagan, Englishtown; Gerald M. Woltermann, Middletown, all of N.J.

[73] Assignee: Engelhard Minerals & Chemicals Corporation, Edison, N.J.

[21] Appl. No.: 173,532

[22] Filed: Jul. 30, 1980

[51] Int. Cl.[3] ..... C10G 11/05

[52] U.S. Cl. ..... 208/120

[58] Field of Search ..... 208/120

[56] References Cited

U.S. PATENT DOCUMENTS

| | | | |
|---|---|---|---|
| 3,669,903 | 6/1972 | Bourguet et al. | 208/120 |
| 3,779,898 | 12/1973 | Youngblood | 208/120 |
| 3,926,780 | 12/1975 | Ward | 208/120 |
| 4,036,739 | 7/1977 | Ward | 208/120 |
| 4,137,152 | 1/1979 | Chester et al. | 208/120 |
| 4,259,212 | 3/1981 | Gladrow et al. | 208/120 |

*Primary Examiner*—Delbert E. Gantz
*Assistant Examiner*—Olik Chaudhuri
*Attorney, Agent, or Firm*—Inez L. Moselle

[57] ABSTRACT

This invention provides an improvement in the operation of an FCCU such as to maintain the octane rating of the gasoline fraction from the cracker at a high level over repeated cycles of cracking charge and regeneration by using fresh zeolitic catalyst particles having an alkali metal oxide less than about 1.5% (based on the zeolite content) and controlling the amount of alkali metal oxide that comes into contact with catalyst inventory throughout cracking, stripping and regeneration so as to maintain alkali metal oxide content of equilibrium catalyst below 2.0%, based on the weight of zeolite in the fresh zeolitic catalyst.

5 Claims, No Drawings

PROCESS FOR PRODUCTION OF HIGH OCTANE GASOLINE FROM CATALYTIC CRACKING UNIT

BACKGROUND OF THE INVENTION

This invention is concerned with improving the octane rating of gasoline produced by fluid catalytic cracking of gas oil feedstock with a zeolitic cracking catalyst having a low sodium content.

Fluid catalytic cracking of hydrocarbon charge to produce gasoline involves cyclic contact of the charge at cracking temperature with a particle form solid cracking catalyst, whereby components of the charge are converted by cracking to lower boiling hydrocarbons including a gasoline fraction with concurrent deposition on the catalyst of an inactivating carbonaceous contaminant. Gasoline is recovered from the products of conversion. Optionally hydrocarbon is stripped by steam from the catalyst particles before activity of the contaminated catalyst is restored by burning the carbonaceous deposit. Catalyst so regenerated is contacted with additional hydrocarbon charge, whereby the catalyst declines in regenerated activity over repeated cycles of charge contact and regeneration. The average activity of the catalyst inventory is maintained at substantially constant equilibrium values by replacing a portion of the catalyst inventory with fresh catalyst of activity above equilibrium values.

When crystalline synthetic zeolite cracking catalysts were introduced to the petroleum industry, improved yields and product slates were realized. These catalysts are composites of crystals of synthetic aluminosilicates disseminated in a porous inorganic oxide matrix. Reference is made to U.S. Pat. Nos. 3,140,249 and 3,932,268 as illustrative examples. In particular, higher gasoline yields were achieved with these highly active catalysts. Modification of cracking equipment and processing parameters to optimize the usefulness of the new zeolitic catalyst followed. While high gasoline yields were achieved at high conversion rates with the synthetic crystalline zeolite catalysts, it was found that gasoline from the fluid cracking units generally had significantly lower octane numbers than gasoline from crackers using catalyst of the type made obsolete by the availability of the more active zeolitic catalysts. The view has been held that the hydrogen transfer capability of the zeolitic catalysts was responsible for the relatively low yield of olefins and that this change in gasoline composition resulted in loss in octane. Some improvement in octane has been achieved by operating the cracker at increased reactor temperature. However, due to recent EPA rulings requiring phase out of lead to improve octane there is increasing pressure on refineries to increase the octane number of FCC gasoline to levels beyond that readily achieved by variation in operation of the cracking unit.

It has been proposed to improve the octane rating of gasoline from an FCC unit by emloying an ultrastable zeolite promoter in the cracking catalyst composition, the zeolite preferably being free of rare earth metal. Reference is made to British Pat. No. 2,022,439. The term "ultrastable" as used in this patent refers to a family of synthetic crystalline aluminosilicate zeolite having a low sodium content and prepared in accordance with the teaching of U.S. Pat. No. 3,293,192 discussed below. The British Patent teaches that the weight percentage sodium oxide ($Na_2O$) in the total catalyst charge to the FCC unit divided by the weight of the zeolite in the catalyst should be equal or less than 0.013. A generally similar disclosure appears in U.S. Pat. No. 3,944,800. The U.S. Pat. No. 3,944,800 discloses that increased yields of more olefinic products are realized when operating FCC units under typical cracking conditions by using a zeolite having a low sodium content and produced by ammonium exchange of a zeolite of the Y type (U.S. Pat. No. 3,130,007), followed by calcination and re-exchange with ammonium. The initial ion-exchange with ammonium salt is carried out at a controlled acidic pH. The resultng ultrastable H-Y zeolite is prepared separately and then combined with the matrix. The patent focuses on the sodium level of the zeolite per se which is in contrast to concern with the sodium level of the catalyst composition.

The effect of the species of exchangeable cations on the catalytic cracking activity is described in a paper "Ion-Exchanged Ultrastable Y Zeolites. 3. Gas Oil Cracking over Rare Earth-Exchanged Ultrastable Y Zeolites" by Julius Scherzer and Ronald E. Ritter, W. R. Grace, Ind. Eng. Chem. Prod. Res. Dev.; 17; 3, 219 (1978). Rare earth exchanged ultrastable zeolites (Re H-USY) are shown to be more active for cracking than are H-ultrastable zeolites (H-USY). However, even the Re-H-USY is less active than typical Re-H-Y zeolite. Re-H-Y is shown to have a higher concentration of Bronsted acid sites than do the H-USY zeolites. The authors suggest that the lower density of acid sites in USY zeolites the rate of conversion of olefins into paraffins and of aromatics into condensed polycyclics (coke), thus allowing the olefins and aromatics to diffuse out of the zeolite and to desorb. Exchange of rare earth into H-USY zeolites tends to increase the rate of these hydrogen-transfer reactions, resulting in more coke and higher conversions. The authors do not discuss the effects of sodium exchange or contamination which would be expected to decrease hydrogen-transfer reactions and lower conversion.

A correlation between acid site density and the composition of FCC gasoline appears in the following publication: "Formation of High Octane Gasoline by Zeolite Cracking Catalysts" by J. S. Magee and R. E. Ritter, W. R. Grace, Paper Presented at ACS Meeting, Sept. 10–15, 1978, Miami Beach, Florida. This paper discusses various process conditions, feedstock and catalyst effects on octane. Y zeolites exchanged with either hydrogen or rare earth are claimed to yield similar octane gasoline at constant severity and conversion level. The authors allege that a recently introduced cracking catalyst that is free from rare earth produces higher octane gasoline than does a commercial REY containing catalyst. Increased aromatic and olefin content of the gasoline produced by that catalyst is claimed. The authors postulate that a combination of reduced acid site density and a change (increase) in the ratio of Lewis/Bronsted acid sites may be causing the observed difference in product quality. No recognition is expressed in this paper of the influence of alkali content of either the fresh or equilibrium catalyst on octane.

Low sodium content zeolites and low sodium content zeolitic cracking catalysts are extensively described in the literature. U.S. Pat. No. 3,293,192 (supra) is an early example of a description of a low sodium zeolite. However this patent is concerned with the production of an ultrastable zeolite but not the use of such zeolite as a component of a cracking catalyst. This is also true of U.S. Pat. No. 3,449,070 which discloses alternative processing to provide an ultrastable zeolite. U.S. Pat. No. Re. 28,629 describes a process for cation exchanging zeolites to produce a low sodium content zeolite product which involved ion-exchanging sodium in a synthetic crystalline zeolite with a solution of a salt of at least one desired metal cation to an alkali content about 3 to 4 weight percent, washing, drying and heating to 400°-1500° F. to redistribute locked-in cations, ion-exchanging to further reduce alkali metal content and drying.

A similar disclosure appears in U.S. Pat. No. 4,058,484 which describes the preparation of stabilized HY zeolites having a $Na_2O$ level below 1.5% and a crystallinity substantially the same as NaY. However this stabilized HY zeolite does not have a reduced cell size such as the reduced cell size which characterizes the ultrastable zeolites described in U.S. Pat. Nos. 3,293,192 and 3,449,070. As described in U.S. Pat. No. 4,058,484 a sodium zeolite Y is ion-exchanged with a ammonium salt solution at a pH of 3-4, heated under relatively mild conditions (300°-400° F.) and washed. The lower sodium level is alleged to improve hydrothermal stability but also to provide increased resistance to metal poisoning. U.S. Pat. No. 4,085,069 is directed to a method of producing a cracking catalyst containing 10-30% of the stabilized low sodium content faujasite of U.S. Pat. No. 4,058,484 (supra). As described in U.S. Pat. No. 4,085,069 such zeolite is composited with 20-70% clay and 10-30% peptized alumina. Again improved stability is alleged but this is the only benefit of maintaining low sodium in the overall catalyst composition. U.S. Pat. No. 4,100,108 alleges a synergistic effect on cracking activity by employing a mixture of two faujasite type zeolites, one containing $2\frac{1}{2}$-5% $Na_2O$ and the other less than $2\frac{1}{2}$% $Na_2O$ in a matrix of alumina and clay. The low sodium zeolite is shown to provide increased activity after a high temperature (1550° F.) laboratory steaming whereas the higher sodium rare earth zeolite provides a higher activity after a 1450° F. steaming. In U.S. Pat. No. 4,100,108 there is no expression of appreciation of the effect of sodium content of the catalyst on octane.

While it is known that high octane gasoline is obtainable, at least on laboratory scale testing, by utilizing cracking catalysts containing ultrastable zeolites which, by their nature are low in sodium content, in practice this knowledge has not led to a commercially significant advance in the operation of catalytic crackers. It has been observed that low sodium catalyst products which, based on laboratory evaluations, promise to enhance octane when employed in commercial FCC units have produced disappointing and perplexing results when operating with equilibrium catalyst.

SUMMARY OF THE INVENTION

This invention provides an improvement in the operation of an FCCU such as to maintain the octane rating of the gasoline fraction from the cracker at a high level over repeated cycles of cracking charge and regeneration by using fresh zeolitic catalyst particles having an alkali metal oxide less than about 1.5% (based on the zeolite content) and controlling the amount of alkali metal oxide that comes into contact with catalyst inventory throughout cracking, stripping and regeneration so as to mainain alkali metal oxide content of equilibrium catalyst below 2.0%, based on the weight of zeolite in the fresh zeolitic catalyst.

In an especially preferred embodiment of the invention the fresh catalyst is prepared by (a) ion-exchanging synthetic sodium faujasite with ammonium ions, leaving residual sodium therein, (b) calcining to facilitate subsequent exchange of residual sodium in the zeolite and (c) ion-exchanging the calcined zeolite with ammonium ions to further reduce sodium, the catalyst also containing an inorganic matrix component which may be mixed with the faujasite before or after steps (a), (b), and (c).

Publications and patents mentioned above lack recognition that sodium poisoning of cracking catalyst during use has any influence on the octane rating of FCCU gasoline. To the best of our knowledge we are the first to appreciate the necessity of controlling contact of a low sodium content zeolitic cracking catalyst with sodium or other alkali metal during use in an FCCU in order to maintain the octane enhancing ability of low sodium content zeolitic catalysts.

Our findings are unexpected when viewed in light of statements appearing in the publication of Scherzer and Ritter (supra). Contrary to the various allegations in the publication we found that while sodium contamination had in fact caused a decrease in coke formations and had reduced conversion, the sodium contamination had also lowered olefin yield and thereby gasoline octane.

PREFERRED EMBODIMENTS

Catalyst particles useful in practice of the instant invention embrace fludizable particles comprising a zeolitic cracking component selected from the group consisting of H-zeolite, $NH_4$-zeolite, ReO-zeolite and mixtures thereof, the catalyst containing a weight of rare earth oxide less than about 5% based on the weight of the zeolite in the fresh catalyst. In a specially preferred embodiment such zeolite is synthetic faujasite having in fresh condition a unit cell size (a) in the range of about 24.30 to 24.75Å as determined by X-ray diffraction. The catalyst particles, in fresh (unused) condition contain less than 1.5% $Na_2O$ (or equivalent other alkali metal oxide) based on the weight of the zeolite component, the amount of zeolite component being estimated by X-ray and typically being in the range of 5 to 30% by weight of the catalyst particles. Most preferably, the fresh catalyst particles contain less than 1.0% by weight $Na_2O$ or equivalent of other alkali metal oxide and preferably they contain less than 0.5% by weight $Na_2O$ based on the weight of the zeolite component. Thus, both the zeolite and the nonzeolite (matrix) component(s) should be very low in sodium and other alkali metal oxides.

The inorganic oxide component of the catalyst particles may be, for example, synthetic silica-alumina, naturally occuring clay, processed clay, as well as mixtures of the aforementioned with inert additives known in the art and utilized as components as cracking catalysts to enhance activity, selectivity, etc. Representative of catalysts that may be used are those described in British Pat. No. 2,022,439, U.S. Pat. Nos. 3,944,800; 4,058,484. Catalysts prepared by the process of U.S. Pat. No. 3,506,594 and having low levels of sodium are recommended.

Catalyst of the invention may be used in conventional FCC units using conventional operating conditions. The invention may also be practiced under cracking and regeneration conditions that represent departures from conventional conditions. Typical conditions for FCC are described in U.S. Pat. No. 3,944,482, the entire disclosure of which is incorporated herein by cross reference thereof.

Practice of our invention preferably involves preventing deposits on fresh low sodium-content zeolitic cracking catalyst inventory of more than about 0.5% by weight sodium oxide based on the weight of the zeolite component of the fresh catalyst and/or other alkali metal oxide during all stages of use. Sources of alkali metal that may contact and deposit on recirculating catalyst during recycling through reactor (cracker), stripper and regenerator include salt transported into the refinery associated with crude oil. Salt in crude at its source is usually higher than salt content entering the refinery due to salting during transport, etc. For purposes of this invention alkali metal, and hence salt content, must be controlled, by desalting if necessary, such that alkali metal from all sources, including alkali metal in processing water contacting catalyst (e.g., steam introduced with feedstock, stripping or during regeneration) does not exceed that which results in the presence of more than 2.0% by weight total alkali metal oxide based on the weight of zeolite in the fresh catalyst. If necessary, conventional crude desalting methods may be used or the FCC feedstock may be desalted. Well known methods for desalting are desribed in Nelson "Petroleum Refinery Engineering," McGraw/Hill, Fourth Edition, 1958, at pages 266–288. Other desalting techniques may be employed. Processing that introduces caustic soda in feedstock for the FCC unit should be avoided or controlled to minimize the amount of sodium that comes into contact with circulating catalyst inventory. Similarly other alkali metals (potassium and lithium) should be controlled. Potassium hydroxide used in alkylation units should not be permitted to contaminate hydrocarbon feedstocks or water introduced to the reactor, etc.

This invention will be more fully understood and the benefits appreciated from the following illustrative examples.

Five FCC catalysts, all free from rare earth, were tested to determine sodium effects on octane. The catalyst used in test 1 was prepared by the general procedure described in U.S. Pat. No. 3,506,594 using repeated contact with an ammonium salt solution to exchange readily exchangeable sodium ions, followed by calcination and re-exchange with ammonium salt solution to reduce further the alkali metal oxide content. The fluid cracking catalyst contained 21% of hydrogen faujasite (24.62 Å cell size) as determined by X-ray diffraction, and 0.20 wt. % $Na_2O$. Matrix was amorphous silica-alumina derived from kaolin clay. In tests 2 to 4 the sodium oxide content of this catalyst was increased as described below. The catalyst used in test 5 contained an ammonium zeolite also prepared by procedures described in U.S. Pat. No. 3,506,594, using repeated contact with an ammonium salt solution to reduce $Na_2O$ without subsequent calcination and re-exchange to reduce further the sodium oxide content. The fresh catalyst used in test 5 had a zeolite content of 25%, as determined by X-ray diffraction, the zeolite having a unit cell size of 24.75 Å.

Test 1. A sample of the above described cracking catalyst was steam treated (100% steam) at 1450° F. for four hours and used to crack gas oil in an FCC pilot unit.

Test 2. 3259 g. of another unsteamed sample of the same batch of fluid cracking catalyst used in Test 1 (21% of a hydrogen faujasite, 24.62 Å cell size, and 0.20 wt. % $Na_2O$) was slurried with a solution containing 4890 ml of $H_2O$ and 175 ml of 2 M NaOH. The slurry was filtered after stirring for 45 minutes at 180° F. The solids were then washed and dried. The final catalyst had an $Na_2O$ content of 0.34%, volatile free (V. F.) weight basis. This catalyst was then steamed at 1450° F. for four hours in 100% steam at atmospheric pressure and used to crack gas oil in an FCC pilot unit.

Test 3. 3398 g. of the same unsteamed batch of fluid catalyst used on test 1 was mixed to incipient wetness with a solution consisting of 2653 ml of $H_2O$ and 15 g NaOH. The impregnated catalyst was dried and found to contain 0.44 wt. % $Na_2O$. The catalyst was steamed at 1450° F. for four hours and used to crack gas oil in an FCC pilot unit.

Test 4. Another sample of the same batch of cracking catalyst used in Test 1 was steamed at 1450° F. for four hours. The steamed catalyst (3405 g) was taken to incipient wetness by impregnation with a solution of 2018 ml of $H_2O$ and 15 g of NaOH. This sample was then dried and found to contain 0.50 wt. % $Na_2O$. The catalyst was used to crack gas oil on an FCC pilot unit.

Test 5. A sample of non-rare earth containing FCC catalyst described above and containing about 25% zeolite and 0.58% $Na_2O$ was steamed for four hours at 1450° F.

Conditions and gasoline octane numbers for the five samples mentioned above are given in the accompanying table. Pilot unit conditions were maintained similar as was conversion so as to influence gasoline octane as little as possible.

EFFECT OF QUANTITY OF $Na_2O$ IN CRACKING CATALYST ON GASOLINE OCTANE

| Ex. | Wt. % $Na_2O$* | Cat/Oil | WHSV | Reactor Temp. | Wt. % Conv. | Gasoline Octane RON | Gasoline Octane MON |
|---|---|---|---|---|---|---|---|
| 1 | 0.95 | 5.92 | 17.93 | 930° F. | 71.7 | 93.6 | 81.7 |
| 2 | 1.62 | 6.31 | 15.96 | 929° F. | 72.4 | 92.5 | 80.4 |
| 3 | 2.10 | 6.75 | 15.90 | 931° F. | 72.1 | 92.2 | 80.4 |
| 4 | 2.38 | 6.63 | 15.85 | 932° F. | 70.1 | 91.7 | 80.3 |
| 5 | 2.32 | 6.34 | 18.49 | 930° F. | 71.9 | 91.6 | 80.7 |

*Based on weight of zeolite component.

Results in the table show that gasoline RON and MON were adversely affected in all cases after sodium poisoning. Reference is made to examples 2, 3 and 4. In fact the higher octane of the gasoline produced with the catalyst containing 0.95% $Na_2O$ based on zeolite content as compared to example 5, 2.32% $Na_2O$ based on zeolite content, disappeared when sodium contamination of the former occurred such that the $Na_2O$ level exceeded 1.62% by weight.

Data in the table demonstrate that in order to maintain the octane enhancing ability of low sodium H-faujasite catalysts, sodium must be prevented from depositing on the catalyst during use.

Our findings reveal that deposition of even small amounts of $Na_2O$ (0.5 wt. % based on zeolite component) have a deleterious effect on octane. It is estimated that a level of 0.5 ppm $Na_2O$ in the gas oil feed will result in sodium poisoning ($Na_2O$ of catalyst 0.1 wt. %) severe enough to cause an octane loss. Thus, the sodium input to the FCC unit must be kept below 0.5 ppm of feed.

What is claimed is:

1. In a process for catalytic cracking of a hydrocarbon charge to produce gasoline by contacting the charge at cracking temperature with a particle form solid cracking catalyst containing a zeolite whereby components of the charge are converted by cracking to lower boiling hydrocarbons including a gasoline fraction with concurrent deposition on the catalyst of an inactivating carbonaceous contaminant, recovering gasoline from said products of conversion, optionally steam stripping hydrocarbon from catalyst, regenerating catalytic cracking activity of the contaminated catalyst by burning carbonaceous deposit therefrom, and contacting catalyst so regenerated with additional such charge, whereby the catalyst declines in activity over repeated cycles of charge contact and regeneration, the average activity of the catalyst inventory being maintained at substantially constant equilibrium values by replacing a portion of the catalyst inventory with fresh catalyst of activity above said equilibrium values;

the improvment whereby the octane rating of said gasoline fraction is maintained at a high level over repeated cycles of charge contact and regeneration, which comprises using fresh catalyst particles containing alkali metal oxide of less than about 1.5% by weight of zeolite content, maintaining the alkali content of said hydrocarbon charge below 0.5 ppm and controlling the amount of alkali metal oxide that comes into contact with catalyst inventory throughout cracking, stripping and regeneration so as to maintain alkali metal oxide content of equilibrium catalyst below 2.0% based on the weight of the zeolite of said catalyst in fresh condition.

2. A process according to claim 1 wherein said fresh catalyst comprises a zeolite component selected from the group consisting of H-zeolite, $NH_4$-zeolite, and mixtures thereof.

3. A process according to claim 2 wherein said zeolite is synthetic faujasite having a unit cell size in the range of about 24.30 to 24.75 A.

4. A process according to claims 2 or 3 wherein said fresh catalyst is prepared by (a) ion-exchanging synthetic sodium faujasite with ammonium ions, leaving residual sodium therein, (b) calcining to facilitate subsequent exchange of residual sodium, and (c) ion-exchanging with ammonium ions to reduce further sodium therein, said catalyst also containing an inorganic oxide matrix component, said matrix component being mixed with said faujasite before or after steps (a), (b), and (c).

5. The process of claim 1 wherein all steam used during cracking, steaming and regeneration that comes into contact with cracking catalyst particles is substantially free from alkali metal.

* * * * *